US009115702B2

(12) United States Patent
Hugosson

(10) Patent No.: US 9,115,702 B2
(45) Date of Patent: Aug. 25, 2015

(54) HYDRAULIC CONTROL SYSTEM

(75) Inventor: Conny Hugosson, Trollhättan (SE)

(73) Assignee: Parker Hannifin Manufacturing Sweden AB, Boras (SE)

( * ) Notice: Subject to any disclaimer, the term of this patent is extended or adjusted under 35 U.S.C. 154(b) by 333 days.

(21) Appl. No.: 13/700,066

(22) PCT Filed: Jul. 6, 2011

(86) PCT No.: PCT/SE2011/050919

§ 371 (c)(1),
(2), (4) Date: Mar. 22, 2013

(87) PCT Pub. No.: WO2012/021101

PCT Pub. Date: Feb. 16, 2012

(65) Prior Publication Data

US 2013/0209276 A1 Aug. 15, 2013

(30) Foreign Application Priority Data

Aug. 9, 2010 (SE) ..... 1050845

(51) Int. Cl.

| | |
|---|---|
| ***F15B 11/08*** | (2006.01) |
| ***F04B 7/00*** | (2006.01) |
| ***E02F 9/22*** | (2006.01) |
| ***F15B 21/00*** | (2006.01) |
| *F15B 13/043* | (2006.01) |

(52) U.S. Cl.

CPC ..... *F04B 7/00* (2013.01); *E02F 9/2203* (2013.01); *E02F 9/2217* (2013.01); *E02F 9/2267* (2013.01); *F15B 21/008* (2013.01); *F15B 13/0431* (2013.01); *F15B 2211/6355* (2013.01); *F15B 2211/8616* (2013.01)

(58) Field of Classification Search

CPC .. F04B 7/00; F15B 21/008; F15B 2211/6355; F15B 2211/8616; F15B 13/0431; E02F 9/2217; E02F 9/2203

USPC ..... 91/484, 486, 461; 417/270

See application file for complete search history.

(56) References Cited

U.S. PATENT DOCUMENTS

| | | | | |
|---|---|---|---|---|
| 3,906,838 | A * | 9/1975 | Hofer | 91/509 |
| 5,245,826 | A | 9/1993 | Roth et al. | |
| 6,279,316 | B1 * | 8/2001 | Vigholm | 60/413 |

(Continued)

OTHER PUBLICATIONS

International Search Report received for PCT Patent Application No. PCT/SE2011/050919, mailed on Sep. 5, 2011, 4 pages.

*Primary Examiner* — Charles Freay

(74) *Attorney, Agent, or Firm* — Renner, Otto, Boiselle & Sklar, LLP

(57) ABSTRACT

The invention relates to a hydraulic system comprising a source of high pressure (A), a consumer (C) connectable to the source of high pressure (A) via a flow control valve (21), and a solenoid valve (22) arranged to control the flow control valve (21). The hydraulic system further comprises a hydraulic pilot valve (31) selectively controllable by the solenoid valve (22) to connect a control chamber (28) in the flow control valve (21) either to the source of high pressure (A) or to a low pressure side (T). When the solenoid valve (22) is actuated, the consumer (C) is pre-pressurized via a by-pass conduit prior to the opening of the flow control valve (21). At the same time, the source of high pressure (A) is arranged to act on a first and a second end (32, 33) of the hydraulic pilot valve (31) wherein a spring (36) is arranged to displace the hydraulic pilot valve (31) and connect the control chamber (28) to the low pressure side (T) to open the flow control valve (21).

13 Claims, 3 Drawing Sheets

(56) References Cited

U.S. PATENT DOCUMENTS 6,351,944 B1 * 3/2002 Fertig et al. ..... 60/413
6,370,874 B1 * 4/2002 Rausch et al. ..... 60/413
2013/0047592 A1 * 2/2013 Opdenbosch et al. ..... 60/327

* cited by examiner

HYDRAULIC CONTROL SYSTEM

CROSS REFERENCE TO RELATED APPLICATIONS

This is a U.S. National Phase patent application of PCT/SE2011/050919, filed Jul. 6, 2011, which claims priority to the Swedish Patent Application No. 1050845-5, filed Aug. 9, 2010, each of which is hereby incorporated by reference in the present disclosure in its entirety.

TECHNICAL FIELD

The present invention relates to hydraulic or oil pressure control systems which are used in oil circuits for driving actuators for stationary or mobile machines, in particular to an oil pressure control system in which a flow control valve is provided in a combined oil input and output circuit of an actuator to control the flow control valve under the control of a pilot valve.

BACKGROUND ART

Hydraulic or oil pressure control systems, which are used in oil circuits for driving actuators for stationary or mobile machines, may sometimes be subjected to sudden changes in pressure. For instance, when activating or starting up a hydraulic system from an inactive state an abrupt increase in pressure may cause a pressure pulse, sometimes referred to as a hydraulic ram. Although such pressure pulses are generally not a problem for hydraulic devices or valves in the system, but may cause undesirable noise and/or vibrations that are noticeable to an operator.

An example of a hydraulic system that may give rise to such problems is shown in FIG. 1. The system comprises a source of high pressure in the form of an accumulator A connected to a non-specific consumer C via a flow control valve 1. The consumer may be a hydraulic cylinder, a hydraulic pump/motor or any such device interacting with hydraulic pressure. Actuation of the flow control valve 1 is controlled by a solenoid valve 2 in the form of a standard two-position solenoid operated valve. The flow control valve 1 comprises a poppet 3 that is spring loaded on by a spring 4 in the direction of a closed position of the flow control valve 1. As shown in the figure, poppet 3 prevents flow between an input/output port 5, connected to the accumulator A, and an output/input port 6, connected to the consumer C. In this context, the term "input/output port" is used for ports where the main direction of flow is from a source of pressure to a load, but where the direction is reversed under certain conditions. Similarly, the term "output/input port" is used for ports where the main direction of flow is from a load to a source of pressure. FIG. 1 shows the system with the solenoid valve 2 held in its non-actuated position by a spring load, wherein the accumulator A is connected to and pressurizes the side of the poppet 3 acted on by the spring 4. This side is referred to as the spring side 8. When the solenoid valve 2 is held in its actuated position, the spring side 8 is instead connected to the tank T.

In operation with the flow control valve 1 in its inactive state, the flow control valve 1 is maintained in its closed position by high pressure from the accumulator A and the spring 4 at the spring side of the poppet 3 in the flow control valve 1. Under transition from active to inactive state of the flow control valve 1, the sum of forces created by the pressure from the accumulator A acting on the input/output port 5 and any pressure from the consumer C acting on the output/input port 6 will be less than the force created by the pressure from the accumulator A acting on the spring side 8 of the poppet 3. Over time, internal leakage through the consumer C, indicated as a throttle 7 between the consumer and the tank T, will cause the pressure at the consumer C to drop to tank, or reservoir, pressure.

In order to operate the consumer C with pressurized hydraulic fluid from the accumulator A, the solenoid valve 2 is actuated in order to pressurize the said consumer C. When the solenoid valve 2 is displaced to its actuated position, hydraulic fluid acting on the spring side 8 of the poppet 3 in the flow control valve 1 is drained to the tank T through a damping throttle 9. High pressure from the accumulator A at the input/output port 5 acting on a poppet ring area of the poppet 3 opens the flow control valve 1. The relatively high pressure difference across the flow control valve 1 causes a relatively abrupt rise in pressure in the consumer C.

An inherent feature of a flow control valve of this type is that a relatively small displacement of the poppet to open the valve will open up a relatively large flow area. The abrupt pressure rise in the flow control valve 1 creates an uncontrolled pressure transient in the consumer, causing a distinct noise similar to a fluid hammer. Immediately after opening, a pressure pulse caused by the pressure transient may cause the pressure in the consumer C to be higher than the pressure in the accumulator A. The damping throttle 9 will only have a limited effect on the rate at which the hydraulic fluid is drained from the spring side 8 and can not eliminate this noise.

A further problem that may occur in hydraulic or oil pressure control systems is a sudden loss of pressure in a consumer or actuator. In the example shown in FIG. 1 the consumer may be, for instance, a hydraulic device that is connected to a supply of hydraulic pressure in the form of an accumulator, as shown in FIG. 1. A sudden loss of pressure in the consumer with a subsequent uncontrolled flow of hydraulic fluid from the supply of hydraulic pressure through the flow control valve may, if not checked, cause damage to the accumulator.

Alternatively, the consumer C may be a hydraulic pump/motor. Under certain conditions, such as a sudden overload of the pump/motor, hydraulic fluid may leak from the cylinders of the pump/motor into the housing surrounding the pump/motor. If the flow of hydraulic fluid is interrupted, the hydraulic pump/motor may resume operation after the excess fluid has been drained out of the said housing. Should the flow of fluid continue, then the pressurized fluid may cause the housing to burst, requiring substantial repairs to the hydraulic pump/motor. The prior art arrangement as shown in FIG. 1 has no means for detecting excessive flow or for interrupting such a flow of hydraulic fluid.

A common way of solving this problem is to provide the system with a hose burst valve. However, this solution requires the mounting of an additional valve in the system and increases the complexity, weight and cost of the system.

One object of the invention is to overcome the above problems by providing an improved hydraulic system that will minimize generation of undesirable noise and/or vibrations caused by pressure pulses. A further object of the invention is to provide an improved hydraulic system that will prevent an uncontrolled flow of hydraulic fluid from the supply of hydraulic pressure caused by a sudden loss of pressure in the consumer.

DISCLOSURE OF INVENTION

The above problems have been solved by a hydraulic system and a method for controlling such a system, according to the appended claims.

According to a preferred embodiment, the invention relates to a hydraulic system comprising a source of high pressure, a consumer connectable to the source of high pressure via a flow control valve, and a solenoid valve arranged to control the flow control valve. The source of high pressure may be any suitable accumulator or pump that is able to supply fluid at a desired working pressure for operating the consumer. The consumer may be any type of device intended to be operated by means of fluid pressure, such as a fluid cylinder or a hydraulic pump/motor. In this context the term "pump/motor" may include fixed displacement pumps/motors as well as variable displacement pumps/motors. Such pumps/motors can be operated as a pump or be driven as a motor. Although the solenoid valve described in the examples below is an electrically operated two-position valve, the invention is not limited to this valve.

The hydraulic system further comprises a hydraulic pilot valve that is selectively controllable by the solenoid valve to connect a control chamber in the flow control valve either to the source of high pressure or to a low pressure side, such as a tank or reservoir, via a drain conduit, preferably comprising a throttle. The invention is not limited to this throttle being included in the hydraulic pilot valve drain conduit.

The flow control valve has an input/output port connected to the source of high pressure and an output/input port connected to the consumer. A poppet or a similar valve body has one operating position which disconnects the input/output port from the output/input port and one operating position which connects the input/output port to the output/input port. The poppet is acted on by a spring force combined with the force created by the pressure in the control chamber on one side and by the combined forces from the pressures of the input/output port and the output/input port on the opposite side. The area of the poppet acted on by the pressure in the control chamber is equal to the combined areas acted on by the pressures in the input/output port and the output/input port. The poppet will remain in its closed position as long as the control chamber is connected to the input/output port and the pressure level at the output/input port is lower than a threshold pressure level. The threshold pressure level is higher than the pressure of the source of high pressure by a difference which is determined by the spring force and the poppet area acted on by the output/input pressure. Threshold pressure can be achieved only if hydraulic fluid flows in direction from the output/input port towards the input/output port. Hence, as long as the control chamber is connected to the input/output port, the flow control valve will remain closed in direction from the input/output port towards the output/input port.

The hydraulic pilot valve has a first end acted on by the force from the pressure of the source of high pressure and a second end acted on by a spring force combined with the force from the pressure at the second end. The spring is arranged to provide a force which is lower than the force from the supply pressure acting on the first end of the hydraulic pilot valve.

The solenoid valve has a supply port connected to the source of high pressure, a load port connected to the second end of the hydraulic pilot valve and the consumer, and a drain port connected to the low pressure side.

When the solenoid valve is non-actuated, the solenoid valve is arranged to connect the second end of the hydraulic pilot valve to the low pressure side via a drain conduit, preferably comprising a throttle. The invention is not limited to this throttle being included in the solenoid valve drain conduit. Hence, as long as the solenoid valve is non-actuated, the source of high pressure acting on the first end of the hydraulic pilot valve will hold the hydraulic pilot valve in a first position wherein the control chamber is connected to the source of high pressure and the flow control valve is closed in direction from the input/output port towards the output/input port.

When the solenoid valve is actuated, the solenoid valve is arranged to connect the source of high pressure to the consumer via a by-pass conduit in order to pre-pressurize the consumer prior to the opening of the flow control valve.

At the same time, the solenoid valve is arranged to connect the source of high pressure to the second end of the hydraulic pilot valve via the by-pass conduit. As soon as the combined forces from the spring and the pressure at the second end of the hydraulic pilot valve exceed the force from the pressure at the first end of the hydraulic pilot valve, the hydraulic pilot valve will displace into a second position in which the control chamber is connected to the low pressure side and the flow control valve is opened. In order to prevent an excessive opening velocity of the control valve poppet, a throttle, acting as a resistance to an abrupt outflow of fluid, may be located in the conduit connecting the control chamber in the flow control valve to the low pressure side. In this way, the throttle acts to prevent an abrupt change in the pressure of the control chamber, whereby the valve body can be smoothly shifted.

A throttle may be located in the by-pass conduit between the first and second ends of the hydraulic pilot valve, preferably between the first end of the hydraulic pilot valve and the solenoid valve. The purpose of this throttle is to create a pressure drop that delays the equalization of pressure between the first and second ends of the hydraulic pilot valve, so that the consumer is at least partially pre-pressurized via the by-pass conduit prior to the switching of the hydraulic pilot valve into its second position and the subsequent opening of the flow control valve.

Pre-pressurization of the consumer may be initiated as soon as the pressure after the throttle is greater than the pressure in the consumer. The consumer may have an internal leakage which, over time, will reduce the pressure in the consumer to ambient pressure, that is, the pressure in the tank or reservoir. The internal leakage must have a flow rate that is less than the flow rate through the throttle.

The throttle between the first and second ends of the hydraulic pilot valve provides a safety function protection the system from a sudden pressure loss in the consumer. This safety function will be described in detail below.

A non-return valve may be located in the by-pass conduit between the second end of the hydraulic pilot valve and the consumer, in order to prevent fluid flow from the consumer towards the second end of the hydraulic pilot valve and the solenoid valve.

Alternatively, the non-return valve may be excluded, if separate by-pass conduits to the consumer and the hydraulic pilot valve are connected to separate load ports in the solenoid valve. Then, the solenoid valve must be of a type which disconnects the load port to which the by-pass conduit to the consumer is connected from the drain port of the solenoid valve when the solenoid valve is non-actuated. However, this alternative solution will require the throttle to be located between the first end of the hydraulic pilot valve and the solenoid valve if protection from a sudden pressure loss in the consumer is required.

The hydraulic system as described above has a safety function that allows the source of high pressure to be disconnected from the consumer if an extensive leak flow occurs in the said consumer. When the solenoid valve and the hydraulic pilot valve are in their actuated positions, the flow control valve is open and enables flow of fluid under pressure flows from the source of high pressure to the consumer. Should an extensive leak occur in the consumer, for instance by a burst fluid conduit or a temporary malfunction in a fluid pump, then it is desired to close the flow control valve in order to prevent an extensive flow level from causing damage to the source of high pressure or to components at the low pressure side.

An extensive leak in the consumer will cause an extensive flow level through the flow control valve in direction from the supply port to the consumer port. That extensive flow will cause a pressure drop across the flow control valve, wherein the pressure at the consumer port will become significantly lower than the pressure at the supply port. However, as long as the pressure available from the source of high pressure is sufficient to counteract the force of the spring, the poppet will not close. At the same time, the pressure will drop in the by-pass conduit. If a non-return valve is located in the by-pass conduit between the second end of the hydraulic pilot valve and the consumer, then the pressure drop across the flow control valve will cause the non-return valve to open. This causes a reduction of the pressure acting on the second end of the hydraulic pilot valve. If the loss of pressure at the consumer is sufficient, the fluid flow rate through the by-pass conduit and the solenoid valve is sufficient to create a pressure drop across the throttle between the first and the second ends of the hydraulic pilot valve. If the pressure at the first end of the hydraulic pilot valve is greater than the pressure at the second end and the force applied by the spring, then the hydraulic pilot valve will be displaced to its non-actuated position by the pressure from the source of high pressure. The source of high pressure will then be connected to the control chamber and the flow control valve will close.

A relatively small amount of fluid will continue to leak past the throttle, the solenoid valve and the non-return valve, towards the consumer, as long as the solenoid valve remains in its actuated position. However, as long as the pressure drop across the throttle is sufficient, the pressure at the first end of the hydraulic pilot valve is greater than the pressure at the second end and the force of the spring. Hence, the hydraulic pilot valve will be held in its non-actuated position and the flow control valve will remain closed. When the pressure loss is detected, e.g. by an operator or a pressure sensor, the solenoid valve may be de-actuated manually or automatically to close the flow control valve.

The consumer may be a reversible, variable displacement pump that can act both as a pump and a motor. In this case, the pump can be connected to an arrangement that can drive the pump or be driven by the motor. When the variable displacement pump is reversed, hydraulic fluid is arranged to flow from the variable displacement pump, past the flow control valve, to the source of high pressure when the fluid pressure delivered by the pump exceeds a predetermined value. An example of this may be a hydraulic hybrid vehicle that can be driven by hydraulic pressure stored in an accumulator.

An example of a hydraulic system in which the arrangement according to the invention may be used is a hydraulic hybrid vehicle, in particular a vehicle that can be driven by hydraulic pressure stored in an accumulator. Typically such vehicles are intended for use in urban areas and/or which is operated with a frequent start/stop cycle. When the vehicle is stationary, a hydraulic drive unit in the form of a reversible, variable displacement pump is disconnected from the supply of hydraulic pressure, such as an accumulator. To start the vehicle, the drive unit is pressurized by actuating a flow control valve according to the invention whereby the drive unit is operated as a motor connected to a transmission and the vehicle can be driven. When the vehicle is to be decelerated or stopped, the drive unit is reversed to act as a pump driven by the vehicle transmission. When the combined forces from pressures of the input/output port and the output/input ports exceed the force from the pressure in the control chamber, including any spring load acting on the poppet, the control valve will open and excess fluid pressure is stored in the accumulator. This allows energy to be regenerated and stored in the form of fluid pressure that may subsequently be used to drive the vehicle.

The invention further relates to a method for controlling a hydraulic system as described above. The method relates to connection a consumer to a source of high pressure and involves the steps of:

- actuating the solenoid valve,
- connecting the source of high pressure to the consumer via a by-pass conduit in order to pre-pressurize the consumer prior to the opening of the flow control valve;
- connecting the source of high pressure to the first end and the second end of the hydraulic pilot valve;
- displacing the hydraulic pilot valve into a second position by means of a spring acting on the second side of the hydraulic pilot valve; and
- connecting the control chamber to the low pressure side to open the flow control valve.

In addition, the method involves controlling the fluid flow through the by-pass conduit using a throttle located between the first and second ends of the hydraulic pilot valve. The pre-pressurization of the consumer may be controlled by providing a flow rate through the throttle that is greater than the internal leakage in the consumer. According to the method, fluid flow from the consumer towards the solenoid valve may be prevented by means of a non-return valve located in the by-pass conduit between the second end of the hydraulic pilot valve and the consumer.

The invention also relates to an alternative method for controlling a hydraulic system as described above. The method relates to disconnection of a consumer from a source of high pressure in case of a leakage in the consumer. This method involves the steps of:

- the leakage causing a pressure drop across the flow control valve (21),
- the leakage causing a pressure drop a the second side (33) of the hydraulic pilot valve (31);
- displacing the hydraulic pilot valve (31) into the first position by means of the pressure from the source of high pressure (A) acting on the first side (32) of the hydraulic pilot valve (31); and
- connecting the control chamber (28) to the source of high pressure (A) to close the flow control valve (21).

In addition, the leakage causes a pressure drop in the by-pass conduit, thereby causing a non-return valve (34) to open and reducing the pressure at the second side (33) of the hydraulic pilot valve (31)

A primary object of the present invention is, therefore, to provide a hydraulic system in which oil pressure may be controlled by a flow control valve that is controlled according to the throttle opening of a pilot valve. Even an abrupt opening of the hydraulic pilot valve enables avoidance of generation of an over-shooting phenomenon and therefore prevention of noise or vibrations in the flow control valve caused by momentary, abrupt operation of an actuator operatively associated with the flow control valve.

A secondary object of the present invention is, therefore, to provide a hydraulic system with a safety function whereby a loss of oil pressure in the consumer may be controlled by a flow control valve that is controlled to close automatically by means of a pilot valve subjected to a pressure drop. A total loss of pressure from the source of high pressure and unnecessary loss of hydraulic oil can therefore be prevented.

BRIEF DESCRIPTION OF DRAWINGS

The invention will be described in detail with reference to the attached figures. It is to be understood that the drawings are designed solely for the purpose of illustration and are not intended as a definition of the limits of the invention, for which reference should be made to the appended claims. It should be further understood that the drawings are not necessarily drawn to scale and that, unless otherwise indicated, they are merely intended to schematically illustrate the structures and procedures described herein.

EMBODIMENTS OF THE INVENTION

Figure 1:
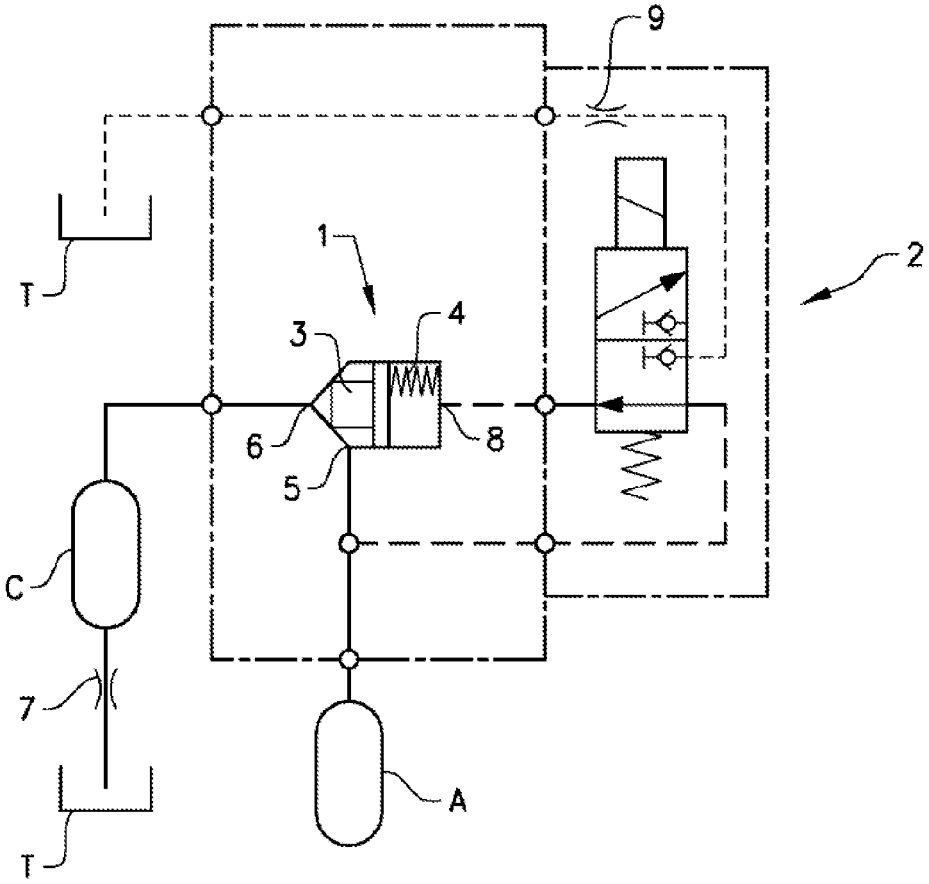
FIG. 1 PRIOR ART
FIG. 1 shows a schematic illustration of a prior art hydraulic system.
Figure 2:
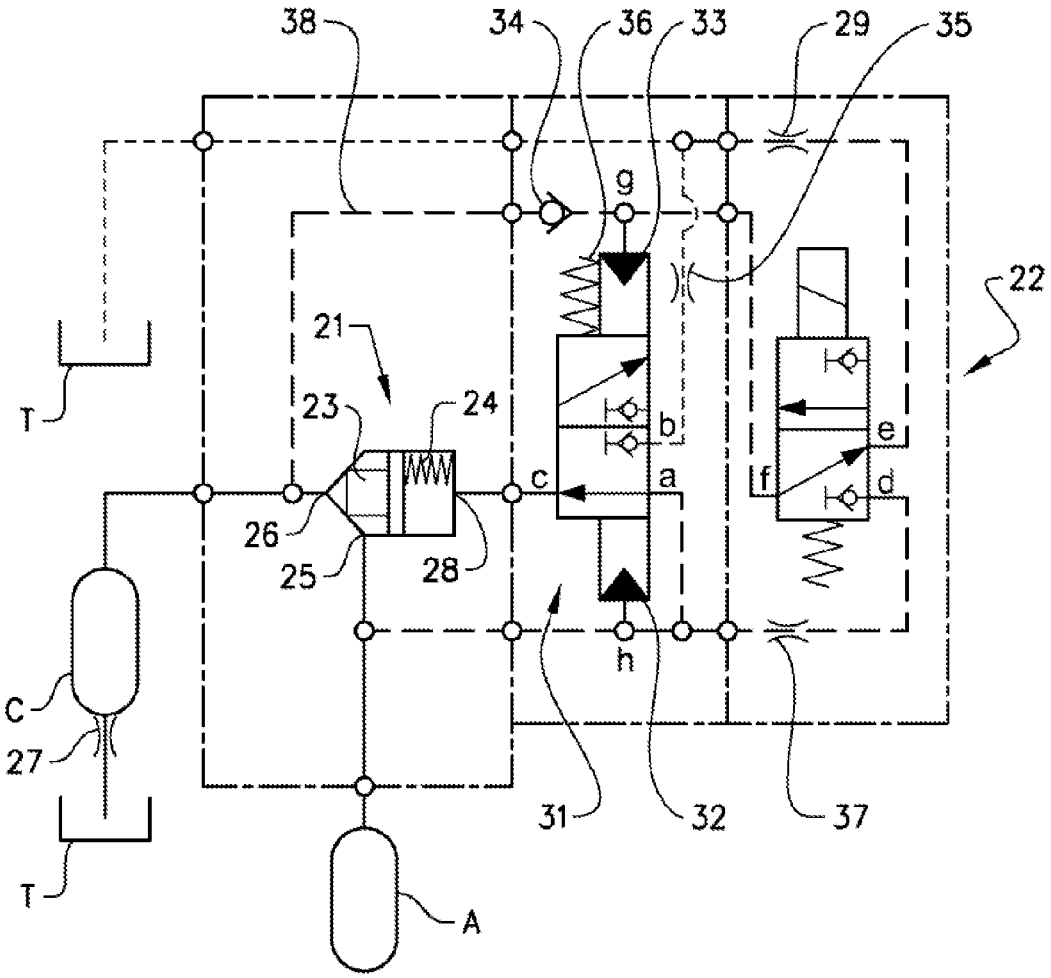
FIG. 2 shows a schematic illustration of a hydraulic system according to a first embodiment of the invention.

FIG. 2 shows a schematic illustration of a hydraulic system according to a first embodiment of the invention. The system comprises a source of high pressure in the form of an accumulator A connected to a consumer C via a flow control valve 21. Actuation of the flow control valve 21 is controlled by a solenoid valve 22 in the form of a standard two-position solenoid operated valve. This solenoid valve is held in a first position by a spring and is electrically actuated by a solenoid into a second position. The flow control valve 21 comprises a valve body such as a poppet 23 that is spring loaded on by a spring 24 in the direction of a closed position of the flow control valve 21. As shown in the figure, poppet 23 prevents flow between an input/output port 25, connected to the accumulator A, and an output/input port 26, connected to the consumer C.

FIG. 2 shows the system with a pilot valve 31 in the form of a two-position hydraulic pilot valve. The hydraulic pilot valve 31 is held in its non-actuated position by fluid pressure from the accumulator A, which is arranged to act on a first side 32 via a port h of the hydraulic pilot valve 31 at all times. In the non-actuated position a supply port a of the hydraulic pilot valve 31 is connected to the accumulator A and a load port c of the hydraulic pilot valve 31 is connected to the flow control valve 21, in order to pressurize a control chamber 28 on the side of the poppet 23 acted on by the spring 24. This side comprising the control chamber and the spring 24 is hereinafter referred to as the spring side 28. A drain port b of the hydraulic pilot valve 31 is connected to the tank T. In its actuated position the supply port a of the hydraulic pilot valve 31 is arranged to disconnect the accumulator A from the load port c and the flow control valve 21. Instead the port c is connected to the drain port b, in order to drain the spring side 28 of the poppet 23 to the tank T.

According to an optional solution, a throttle 35 can be included in the hydraulic pilot valve drain conduit. According to an alternative embodiment, the throttle 35 can be replaced by a combined throttle/non-return valve between the spring side 28 of the poppet 23 and the load part c of the hydraulic pilot valve 31 (FIG. 2). According to a further alternative embodiment, the throttles 29 and 35 can be replaced by a single throttle in the common portion of the drain conduit between the respective solenoid valve 22 and hydraulic pilot valve 31 and the tank T The solenoid valve 22 held in its non-actuated position by a spring load, wherein a supply port d of the solenoid valve 22 is connected to the accumulator A via a control throttle 37. A drain port e of the solenoid valve 22 is connected to the tank T via an optional damping throttle 29. A load port f of the solenoid valve 22 is connected to a port g on a second side 33 of the hydraulic pilot valve 31. In the non-actuated position the load port f is connected to the drain port e, in order to drain the second side 33 to the tank T. The solenoid valve 22 is further connected to the consumer C via a by-pass conduit 38 comprising a non-return valve 34, wherein fluid flow is prevented from the consumer C in the direction of the second side 33 of the hydraulic pilot valve 31 and the tank T.

When actuated, the solenoid valve 22 is displaced into its actuated position by a solenoid, wherein the supply port d of the solenoid valve 22 is arranged to connect the accumulator A to the load port f. The drain port e of the solenoid valve 22 is arranged to interrupt the connection to the tank T. When pressurized, the load port f of the solenoid valve 22 is arranged to supply pressure from the accumulator A to the second side 33 of the hydraulic pilot valve 31 and to the consumer C via the non-return valve 34.

Alternatively, by providing the solenoid valve with two load ports, replacing the single load port f, individual connections can be provided to the consumer and the second end of the hydraulic pilot valve, wherein fluid flow is prevented from the consumer C in the direction towards the solenoid valve when the solenoid valve is in its non-actuated position. When the solenoid valve is actuated, the two load ports are connected to the same supply port and are supplied with pressure from the accumulator A.

In operation with the flow control valve 21 in its inactive state, the flow control valve 21 is maintained in its closed position by high pressure from the accumulator A, supplied by the hydraulic pilot valve 31, and the spring 24 at the spring side of the poppet 23 in the flow control valve 21. While the solenoid valve 22 remains non-actuated, the first end 32 of the hydraulic pilot valve 31 is pressurized by the accumulator A and the second end 33 of the hydraulic pilot valve 31 is drained to tank T to ensure that the hydraulic pilot valve 31 is maintained in its non-actuated position.

Under transition from active to inactive state of the flow control valve 21, the sum of forces created by the pressure from the accumulator A acting on the input/output port 25 and any pressure from the consumer C acting on the output/input port 26 will be less than the force created by the pressure from the accumulator A acting on the spring side 28 of the poppet 23 in addition to the force from the spring 24. Over time, internal leakage through the consumer C, indicated as a throttle 27 between the consumer and the tank T, will cause the pressure at the consumer C to drop to tank pressure.

In order to supply the consumer C with hydraulic pressure, the solenoid valve 22 is actuated in order to connect the said consumer C to the accumulator A. When the solenoid valve 22 is displaced to its actuated position, the supply port d will be connected to the load port f. This actuation will simultaneously initiate two sequential series of events.

In a first series of events, the load port f of the solenoid valve 22 will connect the accumulator A to the consumer C via the throttle 37, located between the accumulator A and the solenoid valve 22, and the non-return valve 34. This will initiate a flow of hydraulic fluid in direction from the accumulator A into the consumer C. The flow will create a pressure drop across the throttle 37, reducing the pressure at the load port f to a level just slightly higher than the pressure in the consumer C.

The flow of hydraulic fluid into the consumer C will initiate an increasing pressure in the consumer C. In order to ensure pressure increase in the consumer C, the flow rate through the throttle 37 must be greater than the flow rate caused by internal leakage through the consumer C, indicated by the throttle 27.

In a second series of events, the load port f of the solenoid valve 22 will connect the increasing pressure downstream of the throttle 37 to the second side 33 of the hydraulic pilot valve 31. Initially, the hydraulic pilot valve 31 will remain in its non-actuated position because the force created by the pressure subjected to its second end 33 in addition to the force from the spring 36 will be lower than the force created by the pressure from the accumulator A subjected to the first end 32 of the hydraulic pilot valve 31. When the pressure at the second end 33 of the hydraulic pilot valve 31 has increased to a level where the difference between the forces created by pressures at the first and second ends 32, 33 becomes smaller than the force from the spring 36 the hydraulic pilot valve 31 will be displaced into its actuated position.

The effect of this displacement is that the load port c of the hydraulic pilot valve 31 is connected to the drain port b. Pressurized hydraulic fluid acting on the spring side 28 of the poppet 23 in the flow control valve 21 will then be drained to the tank T and release the pressure on the spring side 28. Optionally, a throttle 35 can be used to assist in controlling the displacement of the poppet 23 by restricting the fluid flow rate from the spring side 28 towards the tank T. When the pressure on the spring side 28 of the poppet 23 is released, pressure from the accumulator A at the input/output port 25 acting on an annular poppet ring area of the poppet 23 will cause the flow control valve 21 to open. The throttle 35 will assist in limiting the velocity of the poppet 23, thus limiting the impact energy transmitted from the poppet 23 to the body of the flow control valve 21 when the poppet 23 reaches its fully open position.

By selecting a suitable orifice size of the control throttle 37 and a suitable spring constant for the spring 36 acting on the second side of the hydraulic pilot valve 31 it is ensured that the pre-pressurization of the consumer C via the non-return valve 34 reaches a relatively high level before the hydraulic pilot valve 31 is displaced into its actuated position. The pressure difference across the flow control valve 21 is then relatively small when the flow control valve 21 starts to open. This relatively small pressure difference prevents a significant pressure transient from being generated in the consumer C when the flow control valve 21 opens.

Alternatively, the arrangement as shown in FIG. 2 may be operated in a regenerative mode. This is the case when the consumer C comprises a variable displacement pump/motor. The consumer C can be driven as a variable displacement motor supplied by the accumulator, as described above. In the regenerative mode, the variable displacement pump/motor is driven by a rotary axis connected to a wheel axle, a gear box or similar. In order to recover energy, for instance by braking a vehicle, the variable displacement pump/motor is driven as a pump. During a regeneration mode, the solenoid 22 can initially be in its actuated position in order to reduce pressure losses caused by the spring 36 and pressurized fluid on the spring side 28 acting on the poppet 23. As the vehicle is braked towards standstill, the solenoid 22 will be moved to its non-actuated position, as shown in FIG. 2, in order to prevent an unintentional switching of the consumer C from regenerative to motor mode. When the sum of forces created by the pressure from the pump acting on the bottom area of the poppet 23 from the output/input port 26 and the pressure from the accumulator A acting on the annular area of the poppet 23 from the port 25 exceeds the sum of forces created by the pressure from the accumulator A and the force of the spring 24 acting on the spring side 28 of the poppet 23, then poppet 23 will open to allow a flow of hydraulic fluid in the direction towards the accumulator A. When operation of the consumer C in regenerative mode ends, the pressures on all sides of the poppet 23 in the flow control valve 21 will equalize and the flow control valve 21 will be closed by the spring 24. In this context, the wording "all sides of the poppet" refers to the annular input/output side connected to the accumulator A, the output/input side, or the bottom area, connected to the consumer C and the opposite spring side 28, acted on by the spring 24.

The arrangement shown in FIG. 2 also has a safety function that allows the accumulator A to be disconnected from the consumer C, if a sudden loss of pressure occurs in the said consumer. When the solenoid valve 22 and the hydraulic pilot valve 31 are in their actuated positions, the flow control valve 21 is open and the consumer C is exposed to pressure from the accumulator A. Should a sudden leak occur in the consumer, for instance by a burst fluid conduit or a temporary malfunction in a fluid pump/motor, then it is desired to close the flow control valve 21 in order to prevent damage to the accumulator A, to a fluid pump/motor, to the fluid reservoir, etc.

A sudden leak in the consumer C will cause a sudden increase of flow through the flow control valve 21, causing an increase of the pressure drop across the flow control valve 21, wherein the poppet 23 will be displaced to its closed position. However, as long as the pressure available from the accumulator is sufficient to counteract the force of the spring 24, the poppet 23 will not close. At the same time, the pressure difference across the flow control valve 21 will cause the non-return valve 34 to open. This causes a reduction of the pressure acting on the second end 33 of the hydraulic pilot valve 31. If the loss of pressure at the consumer C is sufficient, the fluid flow rate through the solenoid valve 22 is sufficient to create a pressure drop across the throttle 37. If the force created by the pressure at the first end 32 of the hydraulic pilot valve 31 is greater than the sum of forces created by the pressure at the second end 33 and the spring 36, then the hydraulic pilot valve 31 will be displaced to its actuated position and the flow control valve 21 will close.

A relatively small amount of fluid will continue to leak past the throttle 37, the solenoid valve 22 and the non-return valve 34, as long as the solenoid valve remains in its actuated position. However, as long as the pressure drop across the throttle 37 is sufficient, the pressure at the first end 32 of the hydraulic pilot valve 31 is greater than the pressure at the second end 33 and the force of the spring 36. Hence, the hydraulic pilot valve 31 will be held in its actuated position and the flow control valve 21 will remain closed.

Figure 3:
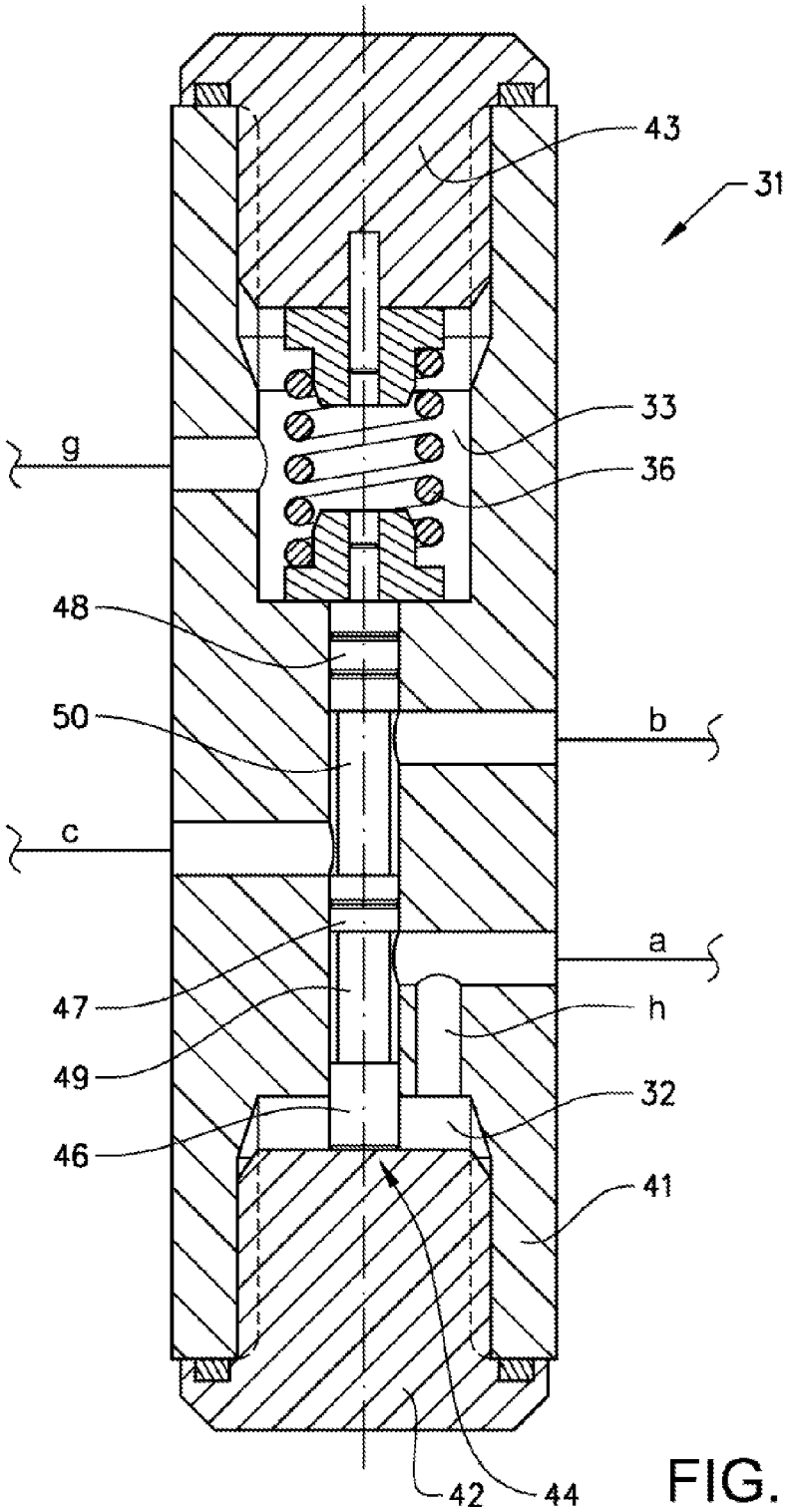
FIG. 3 shows a hydraulically actuated pilot valve according to the invention.

FIG. 3 shows a two-position hydraulically actuated pilot valve 31 according to the invention. The hydraulic pilot valve 31 in FIG. 3 is held in its actuated position by fluid pressure from the accumulator A via the solenoid valve 22 (see FIG. 2), which pressure is arranged to act on the second side 33 of the hydraulic pilot valve 31 as when the solenoid valve 22 is actuated. In this actuated position the supply port a of the hydraulic pilot valve 31 is arranged to disconnect the accumulator A from the load port c and the flow control valve 21. Instead the load port c is connected to the drain port b, in order to drain the spring side 28 of the poppet 23 to the tank T (see FIG. 2). In this example, the hydraulic pilot valve 31 comprises a valve body 41 with a central bore having different diameters. Enlarged cavities are provided at each end of the valve body 41, which cavities are sealed by threaded plugs 42, 43. The said cavities form the first and the second end 32, 33 respectively of the hydraulic pilot valve 31. The first end 32 is connected to the accumulator A via the supply port a, h at all times while a port g at the second end 33 of the hydraulic pilot valve 31 is connectable to the accumulator A or the tank T by the solenoid valve 22. In the example shown in FIG. 3, the port g at the second end 33 is connected to the accumulator A. A spool 44 is slidably located in a bore 45 having a diameter less than that of the respective cavities. The spool has three enlarged sections 46, 47, 48, comprising a first and a second end section 46, 48 and a third section 47 located between the end sections 46, 48, which enlarged sections have substantially the same diameter as the bore 45. The first, second and third sections 46, 47, 48 are separated by first and second intermediate sections 49, 50 of reduced diameter allowing fluid to flow past said intermediate sections.

In FIG. 3 the solenoid valve is actuated and the spool 44 is held in its actuated position by the pressure from the accumulator A at port g and by the spring 36, which in this case is a coil spring acting between the end plug 43 and the second end section 48. In this position the load port c is connected to the drain port b via the second intermediate section 50, in order to drain the spring side 28 of the flow control valve 21 to the tank T (see FIG. 2).

When the solenoid valve is non-actuated the port g is instead connected to the tank T, as shown in FIG. 2. As the supply port a is connected to the accumulator A, the pressure acting on the end surface of the first end section 46 will overcome the force of the spring 36 acting on the second end section 48 and the spool 44 will be displaced to its second end position (see FIG. 2). In this position the supply port a is connected to the load port c, wherein the pressure from the accumulator A will act on the spring side 28 of the flow control valve 21 to close this valve.

The invention is not limited to the above examples, but may be varied freely within the scope of the appended claims.

The invention claimed is:

1. Hydraulic system comprising:

a source of high pressure (A), a consumer (C) connectable to the source of high pressure (A) via a flow control valve, and a solenoid valve arranged to control the flow control valve, wherein the hydraulic system further comprises:

a hydraulic pilot valve that is selectively controllable by the solenoid valve to connect a control chamber in the flow control valve either to the source of high pressure (A) or to a low pressure side (T), wherein the hydraulic pilot valve is configured so that when the solenoid valve is in its first position, the source of high pressure (A) is arranged to act on a first end of the hydraulic pilot valve to hold the hydraulic pilot valve in a first position wherein the control chamber is connected to the source of high pressure (A) and the flow control valve prevents flow from the source of high pressure (A) to the consumer (C), wherein the hydraulic pilot valve is configured so that when the solenoid valve is in its second position, the solenoid valve is arranged to connect the source of high pressure (A) to the consumer (C) via a by-pass conduit in order to pre-pressurize the consumer (C) prior to the opening of the flow control valve; and wherein the source of high pressure (A) is arranged to act on the first end and on a second end of the hydraulic pilot valve wherein a spring acting on the second side is arranged to displace the hydraulic pilot valve into a second position in which the control chamber is connected to the low pressure side (T) and the flow control valve is opened.

2. Hydraulic system according to claim 1, wherein a non-return valve is located in the by-pass conduit between the second end of the hydraulic pilot valve and the consumer (C), in order to prevent fluid flow from the consumer (C) towards the solenoid valve.

3. Hydraulic system according to claim 1, wherein a throttle is located between the first and second ends of the hydraulic pilot valve.

4. Hydraulic system according to claim 1, wherein the source of high pressure (A) is in the form of an accumulator.

5. Hydraulic system according to claim 1, wherein the consumer (C) is a reversible pump/motor.

6. Hydraulic system according to claim 5, wherein, when the variable displacement pump/motor is reversed, hydraulic fluid is arranged to flow from the variable displacement pump/motor, past the flow control valve, to the source of high pressure (A) when the fluid pressure delivered by the pump exceeds the fluid pressure of the source of high pressure (A) with a predetermined value.

7. Method for controlling a hydraulic system according to claim 1, wherein, in order to connect a consumer (C) to a source of high pressure (A), the method involves the steps of:

actuating the solenoid valve, connecting the source of high pressure (A) to the consumer (C) via a by-pass conduit (38) in order to pre-pressurize the consumer (C) prior to the opening of the flow control valve;

connecting the source of high pressure (A) to the first end and the second end of the hydraulic pilot valve;

displacing the hydraulic pilot valve into a second position by means of a spring acting on the second side of the hydraulic pilot valve; and connecting the control chamber to the low pressure side (T) to open the flow control valve.

8. Method according to claim 7, further comprising controlling the fluid flow through the by-pass conduit using a throttle located between the first and second ends of the hydraulic pilot valve.

9. Method according to claim 8, further comprising controlling the pre-pressurization of the consumer (C) having an internal leakage by providing a flow rate through the throttle that is greater than the internal leakage.

10. Method according to claim 7, further comprising preventing fluid flow from the consumer (C) towards the solenoid valve by means of a non-return valve located in the by-pass conduit between the second end of the hydraulic pilot valve and the consumer (C).

11. Method according to claim 7, further comprising preventing fluid flow from the source of high pressure (A) to the consumer (C) if a pressure loss occurs in the consumer (C), wherein said pressure loss causes a pressure drop at the second end of the hydraulic pilot valve, causing a displacement of the hydraulic pilot valve into the first position and closure of the flow control valve.

12. Method for controlling a hydraulic system according to claim 1, wherein, in order to disconnect a consumer (C) from a source of high pressure (A) in case of a leakage in the consumer, the method further involves the steps of:

the leakage causing a pressure drop across the flow control valve, the leakage causing a pressure drop a the second side of the hydraulic pilot valve;

displacing the hydraulic pilot valve into the first position by means of the pressure from the source of high pressure (A) acting on the first side of the hydraulic pilot valve; and connecting the control chamber to the source of high pressure (A) to close the flow control valve.

13. Method according to claim 9, wherein the leakage causes a pressure drop in the by-pass conduit, thereby causing a non-return valve to open and reducing the pressure at the second side of the hydraulic pilot valve.

* * * * *